US006216368B1

(12) United States Patent
Bierwith

(10) Patent No.: US 6,216,368 B1
(45) Date of Patent: Apr. 17, 2001

(54) EXCAVATING BUCKET WITH REPLACEABLE WEDGE-LOCKED TEETH

(76) Inventor: Robert S. Bierwith, 1331 Eastshore Hwy., Berkely, CA (US) 94710

( * ) Notice: Subject to any disclaimer, the term of this patent is extended or adjusted under 35 U.S.C. 154(b) by 0 days.

(21) Appl. No.: 09/329,989

(22) Filed: Jun. 9, 1999

Related U.S. Application Data

(60) Provisional application No. 60/089,357, filed on Jun. 15, 1998.

(51) Int. Cl.[7] ..... E02F 9/28

(52) U.S. Cl. ..... 37/457

(58) Field of Search ..... 37/452, 453, 454, 37/455, 456, 457; 172/123, 699, 701.2, 713, 719, 749, 751; 299/91, 92; 403/355, 375

(56) References Cited

U.S. PATENT DOCUMENTS

| | | | | |
|---|---|---|---|---|
| 4,267,653 | * | 5/1981 | Hahn et al. | 37/457 |
| 4,282,665 | * | 8/1981 | Fletcher et al. | 37/457 |
| 4,748,754 | * | 6/1988 | Schwappach | 37/457 |
| 4,835,888 | | 6/1989 | Hemphill . | |
| 4,881,331 | * | 11/1989 | Paizes | 37/457 |
| 5,184,412 | * | 2/1993 | Kopinski et al. | 37/457 |
| 5,311,681 | | 5/1994 | Ruvang et al. . | |
| 5,331,754 | | 7/1994 | Ruvang . | |
| 5,361,520 | | 11/1994 | Robinson . | |
| 5,465,512 | * | 11/1995 | Livesay et al. | 37/457 |

FOREIGN PATENT DOCUMENTS

| | | |
|---|---|---|
| 2023 106 | 11/1970 | (DE) . |
| 0 203 315 A2 | 2/1986 | (EP) . |
| 1 476 822 | 6/1975 | (GB) . |

* cited by examiner

*Primary Examiner*—Robert E. Pezzuto
(74) *Attorney, Agent, or Firm*—Townsend and Townsend and Crew LLP

(57) ABSTRACT

An excavating bucket assembly for excavation apparatus that does not use pins to connect teeth to adaptors on the excavation bucket. Each adaptor includes a receiving portion defined therein that is at least partially defined by an abutment wall. Each tooth includes an interference portion. The connection system includes a biasing portion adjacent the abutment wall and a locking portion adjacent the biasing portion. The locking portion includes a locking section and an interference section that engages the interference portion of its respective tooth. The locking section and the interference section are capable of movement relative to one another to thereby couple the tooth to the adaptor.

6 Claims, 10 Drawing Sheets

EXCAVATING BUCKET WITH REPLACEABLE WEDGE-LOCKED TEETH

This application claims priority from and the benefit of U.S. Provisional Application No. 60/089,357, filed Jun. 15, 1998, which is hereby incorporated herein by reference for all purposes.

BACKGROUND OF THE INVENTION

1. Field of the Invention

The present invention relates to digging buckets for excavation vehicles and equipment such as front-end loaders and, more particularly, to a connection system for connecting replaceable teeth to such digging buckets.

2. Description of the Prior Art

Excavating buckets are used extensively in the construction and mining industries. The buckets are used with a variety of different excavating apparatus, such as backhoes, power shovels, front-end loaders, dragline equipment, etc., for digging, loading, etc. Although these buckets have many differences, they are generally formed with a rear wall, side walls, and a bottom wall. The walls cooperatively define an open front and a cavity for gathering earthen material and moving it to a dump site. The bottom edge of the open front is defined by a forward lip of the bottom wall. The lip is intended to engage the ground for collection of the earthen material into the bucket cavity. The lip may be formed to have a linear or arcuate-shaped edge or formed to have a particular configuration (such as V-shaped) to suit the desired operation. Similarly, the front edges of the side walls are also adapted to engage the ground.

Attachments are commonly mounted on the lip and front edges of the side walls to increase the effectiveness and durability of the buckets. These attachments typically include teeth, shrouds and wings. The teeth project forwardly of the lip to disrupt the material for enhanced collection of the material into the cavity. The shrouds are positioned in-between the teeth and are generally provided with an inclined surface to improve the collection of the material into the bucket. The wings are attached to the front edges of the side walls in general proximity with the lips. In any event, the attachments protect the bucket against undue wear. As a result, only the attachments normally need replacement when the front of the bucket becomes worn, thus prolonging the usable life of the larger and more expensive lip and side walls.

Generally, a tooth is attached to the lip with an adaptor. The tooth in turn is attached to the adaptor with a pin. In order to replace the tooth, the pin is knocked out with a large hammer. During this process, the pin is destroyed, which means that a new pin is needed to attach the new tooth to the adaptor. This is a non-desirable cost since pins typically cost in the range of $25.00–$50.00 each.

Furthermore, use of the large hammer to knock the pin out of the tooth-adaptor connection may be dangerous. There is a danger of injury to bodily parts, especially fingers, and also a danger from flying pieces or chips from the pin or other parts, or from dirt, debris, sand, dust, etc. in the connection area.

Another problem with current connection techniques lies in the fact that the interface between the tooth and its associated adaptor is not adequately sealed. Thus, dirt, sand, grit, and abrasives enter the interface between the tooth and adaptor and slowly grinds or wears the two parts. This wear loosens the tightness of the fit, and thus, new teeth may "wiggle" and may be quickly damaged or broken. Due to this wear, it is necessary to relatively frequently replace the adaptor. Currently, a new adaptor is required for every 10–20 teeth that are installed on the associated adaptor. The frequency of the replacement of the adaptor depends on the amount of use, the type of soil, etc.

SUMMARY OF THE INVENTION

An excavation bucket with a connection system that connects teeth to adaptors in accordance with the present invention addresses the shortcomings of the prior art.

In its broadest sense, the present invention provides a connection system for connecting a first item and a second item, the first item including a receiving portion defined at least partially by an abutment wall and the second item including an interference portion, wherein the connection system comprises a biasing portion and a locking portion adjacent the biasing portion. The biasing portion is adjacent the abutment wall when the connection system is in use. The locking portion includes a locking section and an interference section that engages the interference portion when the connection system is in use. The locking section and the interference section are capable of movement relative to one another.

In a preferred embodiment, a digging bucket assembly for an excavation apparatus that includes a bucket body having a lip running longitudinally along the bottom front portion of the bucket body has a plurality of adaptors connected thereto. Each adaptor includes a receiving portion defined therein that is at least partially defined by an abutment wall. The digging bucket further includes a corresponding plurality of teeth each connected to a respective adaptor with a connection system. Each tooth includes an interference portion. The connection system comprises a biasing portion adjacent the abutment wall and a locking portion adjacent the biasing portion. The locking portion includes a locking section and an interference section that engages the interference portion of its respective tooth. The locking section and the interference section are capable of movement relative to one another.

In accordance with one aspect of the present invention, the locking section and interference section are separate pieces that are adjacent one another.

In accordance with another aspect of the present invention, the locking section is connected to the biasing portion via a hinge.

In accordance with a further aspect of the present invention, the interference section and the locking section each include an angled surface that are adjacent one another.

In accordance with yet another aspect of the present invention, the biasing portion includes a biasing section consisting of an elastomeric material and an abutment section.

In accordance with a further aspect of the present invention, the abutment section consists of a substantially non-elastomeric material.

In accordance with another aspect of the present invention, the interference portion comprises a notch defined within its respective tooth and the interference section comprises a projection.

In accordance with a further aspect of the present invention, the biasing section and the abutment section are connected with a hinge.

In accordance with a further aspect of the present invention, the connection system extends substantially along a width defined within the receiving portion.

Accordingly, the present invention provides a connection system that is ideally suited for connecting teeth of a digging bucket to adaptors located along a front lip of the digging bucket without the need for pins. The connection system is easy to fabricate and, since it preferably extends within the width of the receiving portion of the adaptor, no dirt can enter between the tooth and the portion of the adaptor over which it extends. The locking portion of the connection system fully engages the tooth and the adaptor, with the interference section fully engaging the interference portion of the tooth thus providing a tight fit and helping prevent relative motion between the tooth and its associated adaptor.

The connection system is reusable and thus, pin replacement is eliminated, thereby saving money for each tooth replacement.

The connection system may be easily removed to replace its associated tooth and thus there is no need for a hammer thereby reducing the possibility of injuries when replacing teeth.

Other features and advantages of the present invention will be understood upon reading and understanding the detailed description of the preferred exemplary embodiments found herein below, in conjunction with reference to the drawings, in which like numerals represent like elements.

DETAILED DESCRIPTION OF THE PREFERRED EXEMPLARY EMBODIMENTS

Figure 4:
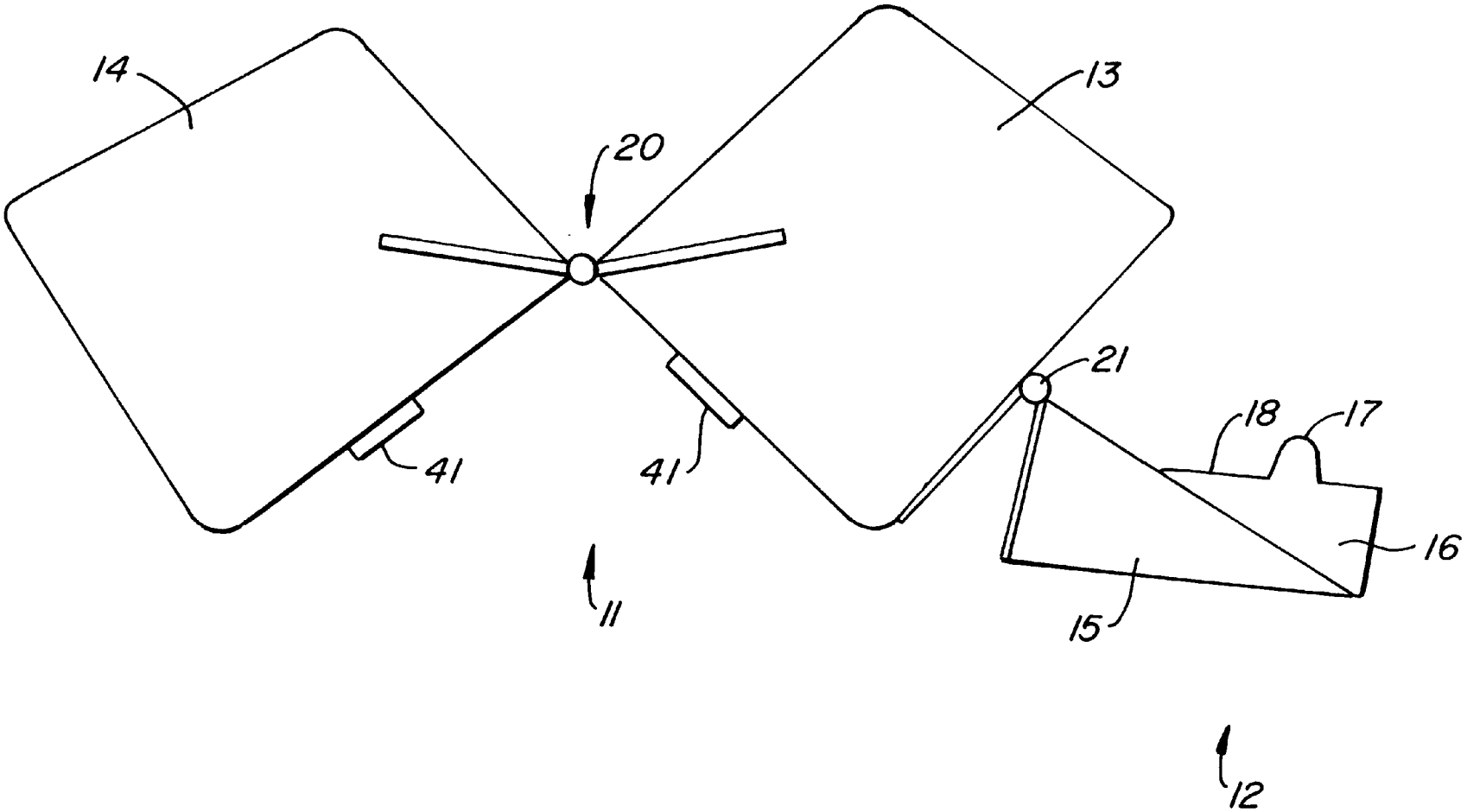
FIG. 4 is a side elevation view of the embodiment of the connection system illustrated in FIG. 1.

With reference to FIG. 4, a connection system 10 includes a biasing portion 11 and a locking portion 12. Preferably, the biasing portion includes a biasing section 13 and an abutment section 14. The locking portion preferably includes a locking section 15 and an interference section 16. In a first preferred embodiment, both the biasing section and abutment section consist of an elastomeric material such as rubber, plastic, etc., while the locking section and interference section both preferably consist of a non-elastomeric material, most preferably, metal. In a preferred embodiment, interference section includes a projection 17 defined on an upper surface 18.

In a preferred embodiment, biasing section 13 and abutment section 14 are coupled together via structure to inhibit their moving upward or "opening-up." Preferably, this is accomplished with an over-center hinge 20. Locking section 15 is preferably coupled to biasing portion 11 with a hinge 21. Preferably, the hinge couples locking section 15 to biasing section 13. The hinge is vulcanized to the rubber in a preferred embodiment and is connected to the metal locking section with a suitable connection such as a bolt, a weld, etc.

As will become apparent herein, interference section 16 and locking section 15 are capable of movement relative to one another. This may be accomplished by suitable connection means such as an elastomeric material, rollers, etc. In the preferred embodiment, locking section 15 and interference section 16 are two separate pieces. Preferably both locking section 15 and interference section 16 have angled surfaces 22, 23, respectively. When connection system 10 is used, angled surface 22 and angled surface 23 engage one another as can be seen in FIG. 4. Hence, locking section 15 and interference section 16 preferably have substantially wedge shapes.

Connection system 10 also includes an assembly/disassembly portion 24. Assembly/disassembly portion 24 includes a body 25 that engages over-center hinge 20 and a head 26. Additionally, a slot 27 is defined within a top portion of body 25.

Connection system 10 can be used for connecting two items that are appropriately configured for receiving the connection system. Connection system 10 is ideally suited for connecting a tooth 30 to an adaptor 31. Adaptor 31 is connected to a front lip 32 of an excavation bucket 33 that is used with excavation equipment. Adaptor 31 and tooth 30 may be attached to any part of an excavation-type piece of machinery that uses such teeth.

Figure 3:
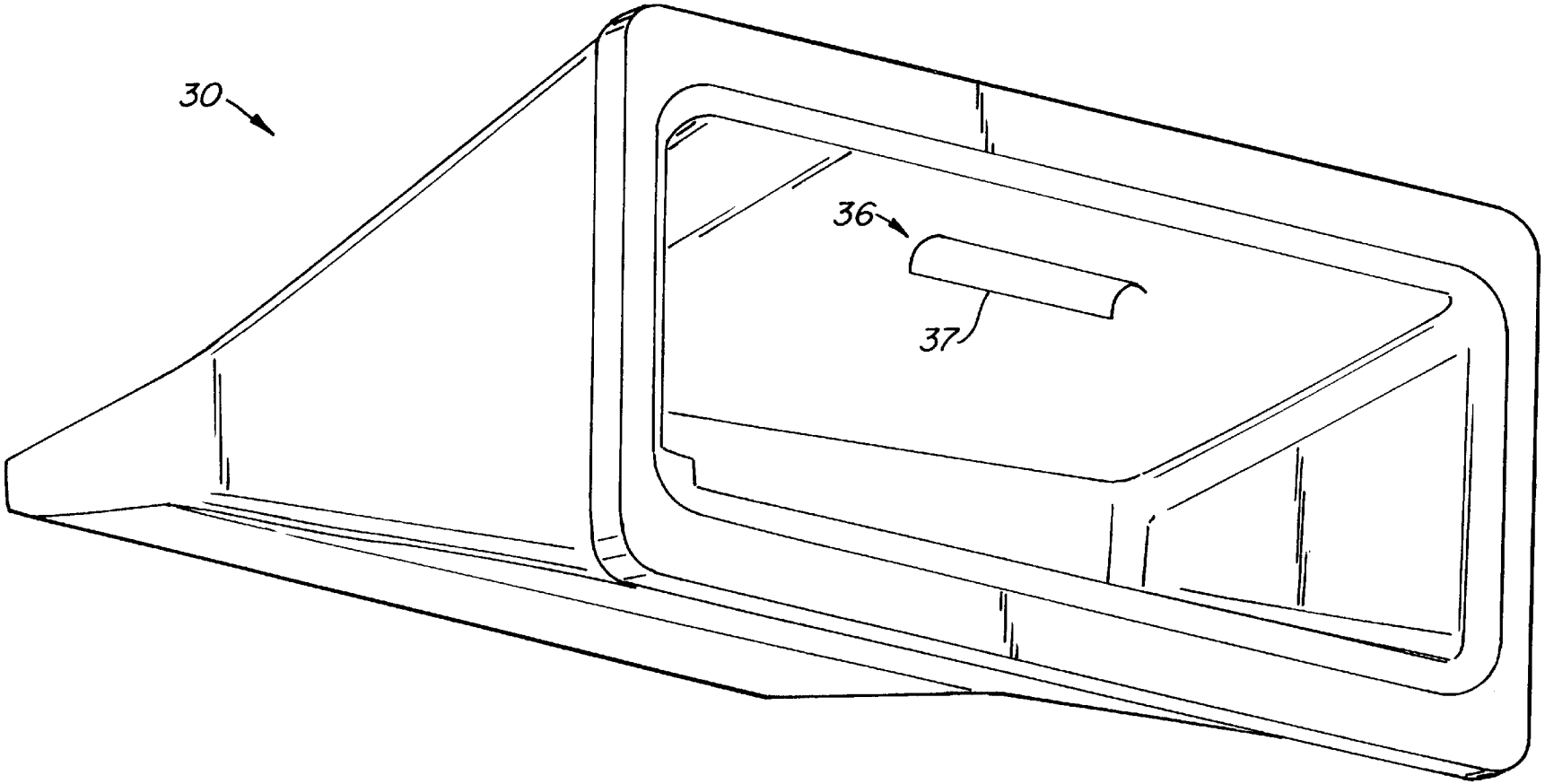
FIG. 3 is a perspective view of a tooth and its interior for use with digging buckets.

FIG. 3 illustrates connection system 10 mounted within a receiving portion 34 defined within adaptor 31. Receiving portion 34 includes an abutment wall 35. To install the connection system, and thereby connect a tooth to an adaptor, the connection system is placed in the receiving portion in a "open" position, i.e., biasing section and abutment section have space between them. Interference section 16 is placed on locking section 15 such that their angled surfaces 22, 23 are engaged. Tooth 30 is placed over interference section 16 such that projection 17 engages interference portion 36 defined within tooth 30. Interference portion 36, as can be seen in the drawings, is preferably a notch that cooperates with projection 17 to form an interference fit.

Once tooth 30 is in place such that projection 17 and interference portion 36 are cooperating, assembly/disassembly portion 24 is pushed at head 26 to force biasing section 13 and abutment section 14 together i.e., to substantially flatten connection system 10. Back wall 40 of abutment section 14 engages abutment wall 35. Preferably metal slide bars 41 are provided under biasing section 13 and abutment section 14 to allow these sections to slide along the metal surface of receiving portion 34 defined within adaptor 31.

Locking section 15 is capable of sliding under interference section 16 as connection system 10 is flattened out. This helps pull tooth 30 tightly onto adaptor 31. This self tightening feature of connection system 10 pulls a bottom portion 34 of tooth 30 tightly against a bottom portion 43 of nose 44 of adaptor 31. A top portion 45 of tooth 30 has a slight clearance between a top portion 46 of adaptor 31. In a current prototype embodiment of a tooth connected with connection system 10 to an adaptor, the clearance between top 45 and top 46 is approximately 1/32 inches. Thus, a lower tolerance is required when manufacturing teeth 30 since connection system 10 has such a self-tightening feature.

Receiving portion 34 and connection system 10 have substantially the same width and preferably extend substantially along the width of the interior of teeth 30. Additionally, the interior of teeth 30 and corresponding surfaces of the adaptors are form-fitted (except for the previously mentioned clearance area between the tops 45, 46). Thus, when connection system 10 is assembled and connecting a tooth to an adaptor, a seal is provided between the adaptor and the interior of the tooth. Accordingly, connection system 10 helps prevent sand, dirt, dust, abrasives, etc. and other debris from entering tooth 30 and "grinding" away at nose 44 of the adaptor, thereby prolonging the life of adaptor 31.

To remove connection system 10 and replace tooth 30, a prybar (not shown) or other suitable tool is used to pull assembly/disassembly portion 24 by engaging slot 27, thereby "opening-up" biasing portion 11. Connection system 10 may then be removed by pulling out biasing portion 11 thereby pulling out locking section 15 and disengaging interference section 16 from interference portion 36. A new tooth is then placed onto the adaptor as previously described.

As stated previously, biasing portion 11 is preferably made of an elastomeric material, most preferably rubber. This allows connection system 10 to tightly and snugly fit within receiving portion 34. When the bucket that includes the teeth/adaptor/connection system as described is used, lateral forces are transferred between the teeth and the adaptors due to their tight fit.

Figure 1:
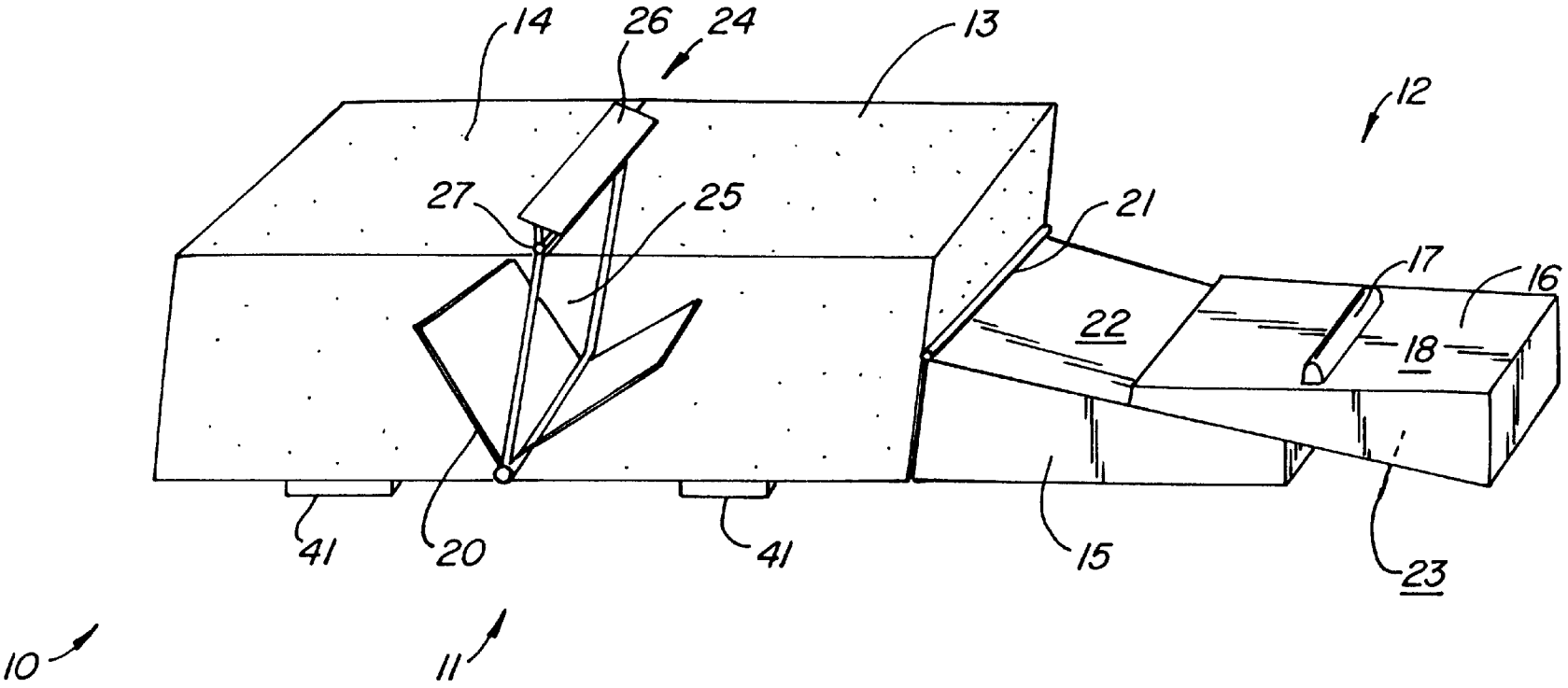
FIG. 1 is a perspective view of a connection system in accordance with the present invention.
Figure 2:
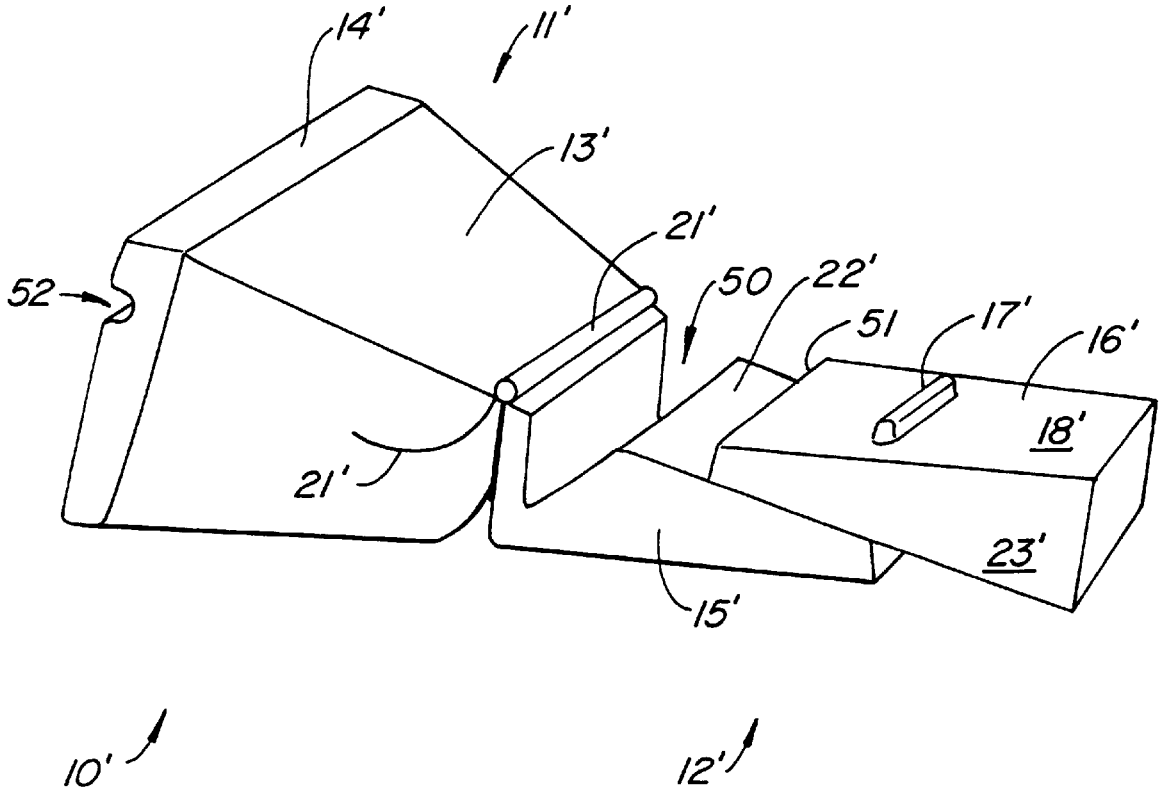
FIG. 2 is a perspective view of an alternative embodiment of a connection system in accordance with the present invention.
Figure 5A:
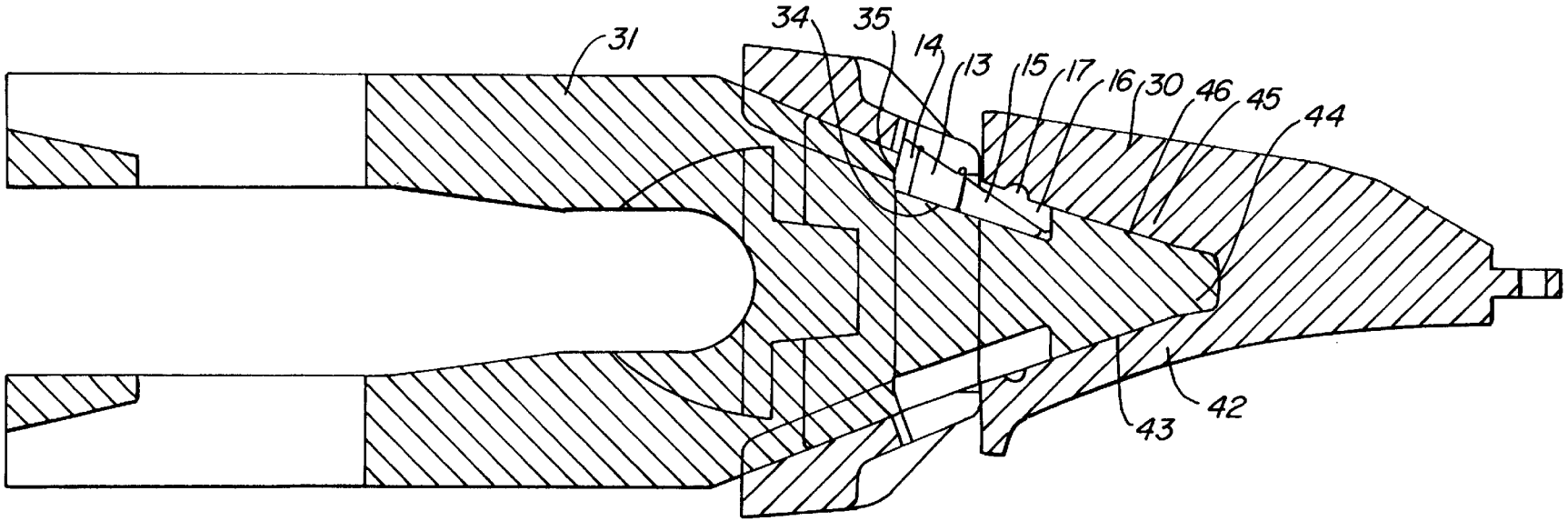
FIG. 5A is a sectional view of the connection system illustrated in FIG. 2 coupling a tooth to an adaptor.
Figure 5B:
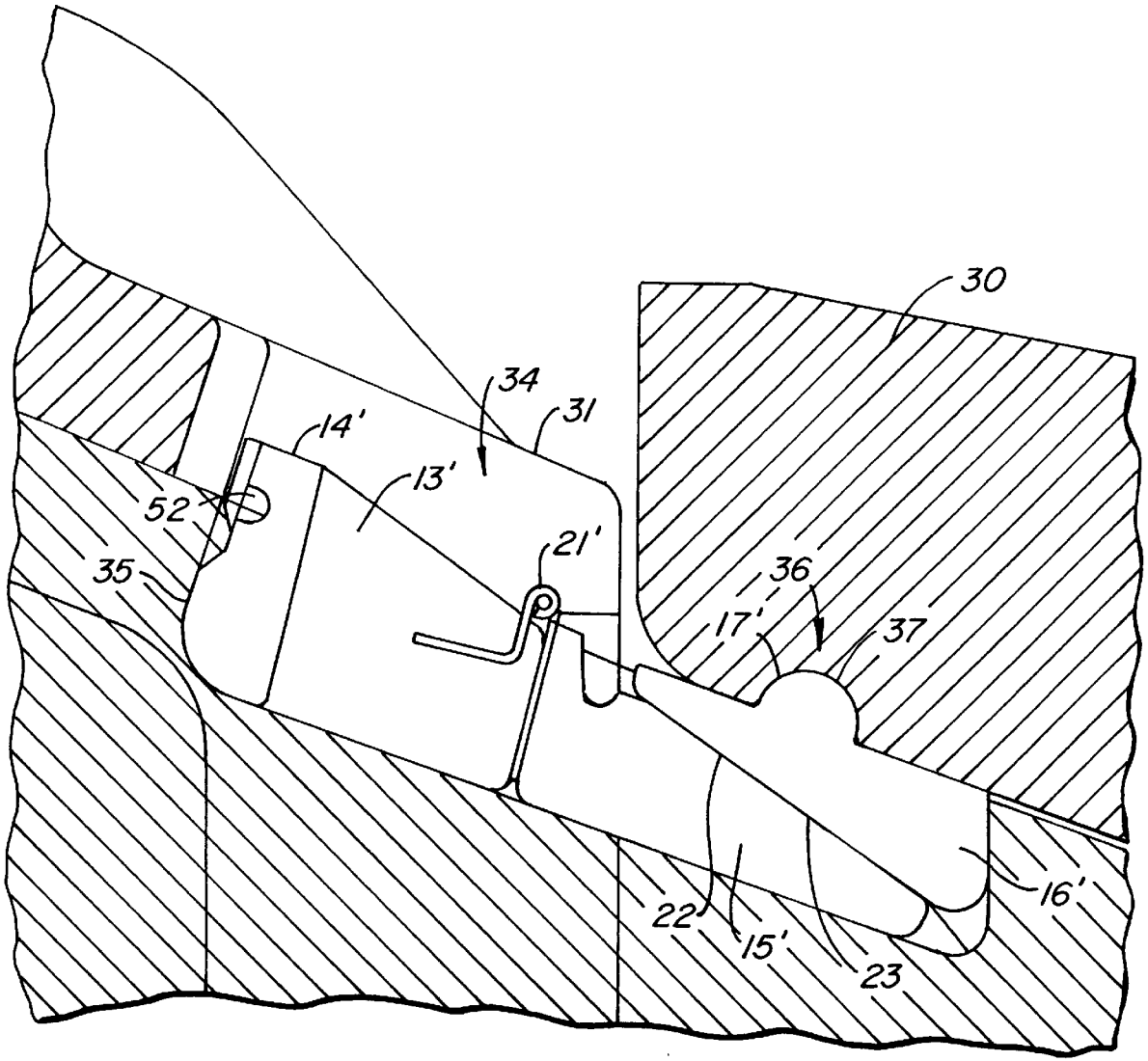
FIG. 5B is an enlarged sectional view of the connection system illustrated in FIG. 2 coupling a tooth to a connector.

With reference to FIGS. 2, 5A and 5B, an alternative embodiment of connection system 10' includes a biasing portion 11' and a locking portion 12'. The biasing portion includes a biasing portion 13' and an abutment section 14'. Finally, connection system 10' includes interference section 16' that includes projection 17' on an upper surface 18'.

Preferably, abutment section 14' consists of a non-elastomeric material, most preferably metal, and a biasing section 13' preferably consists of an elastomeric material such as rubber, plastic, etc. Preferably biasing section 13' consists of rubber. Preferably locking portion 12' consists of a non-elastomeric material, most preferably metal, and interference section 16' preferably consists of a non-elastomeric material, most preferably metal. Abutment section 14' is preferably connected to biasing section 13' with a hinge 21'. A portion of the hinge is vulcanized into rubber biasing section 13' while another portion of hinge 21' is connected to locking portion 12' with bolts, weldings, etc.

Both locking portion 12' and interference section 16' preferably include angled surfaces 22', 23', respectively. When connection section 10' is used, interference section 16' engages locking portion 12' such that angled surface 23' engages angled surface 22'.

Connection system 10' can assume a substantially wedge shape when it is not being used by folding locking portion 12' over biasing portion 11'. Notch 50 defined within locking portion 12' is placed over hinge 21.

To couple a tooth 30 with an adaptor 31 using connection system 10', interference section 16' is placed within receiving portion 34. Tooth 30 is placed over interference section 16' such that interference portion 36 engages interference section 16'. The front edge 51 of interference section 16' is lifted and locking portion 12' is placed under interference section 16'. Connection system 10' is pushed snugly into receiving portion 34 such that abutment section 14' engages abutment wall 35. Because of the angled surfaces 22', 23', locking portion 12' slides underneath interference section 16' and snugly pulls tooth 30 onto adaptor 31 as previously described. Once again because the tooth is form-fitted with the adaptor along the sides and bottom, but not the top, the tooth tightly and snugly is coupled to the nose of the adaptor. A clearance is once again provided along the top of the nose of the adaptor, which is sealed by connection system 10'.

To remove connection system 10', a prybar or other suitable tool is used to engage notch 52 defined in abutment section 14' to pull up on connection system 10' thereby "popping out" connection section 10'.

Figure 6:
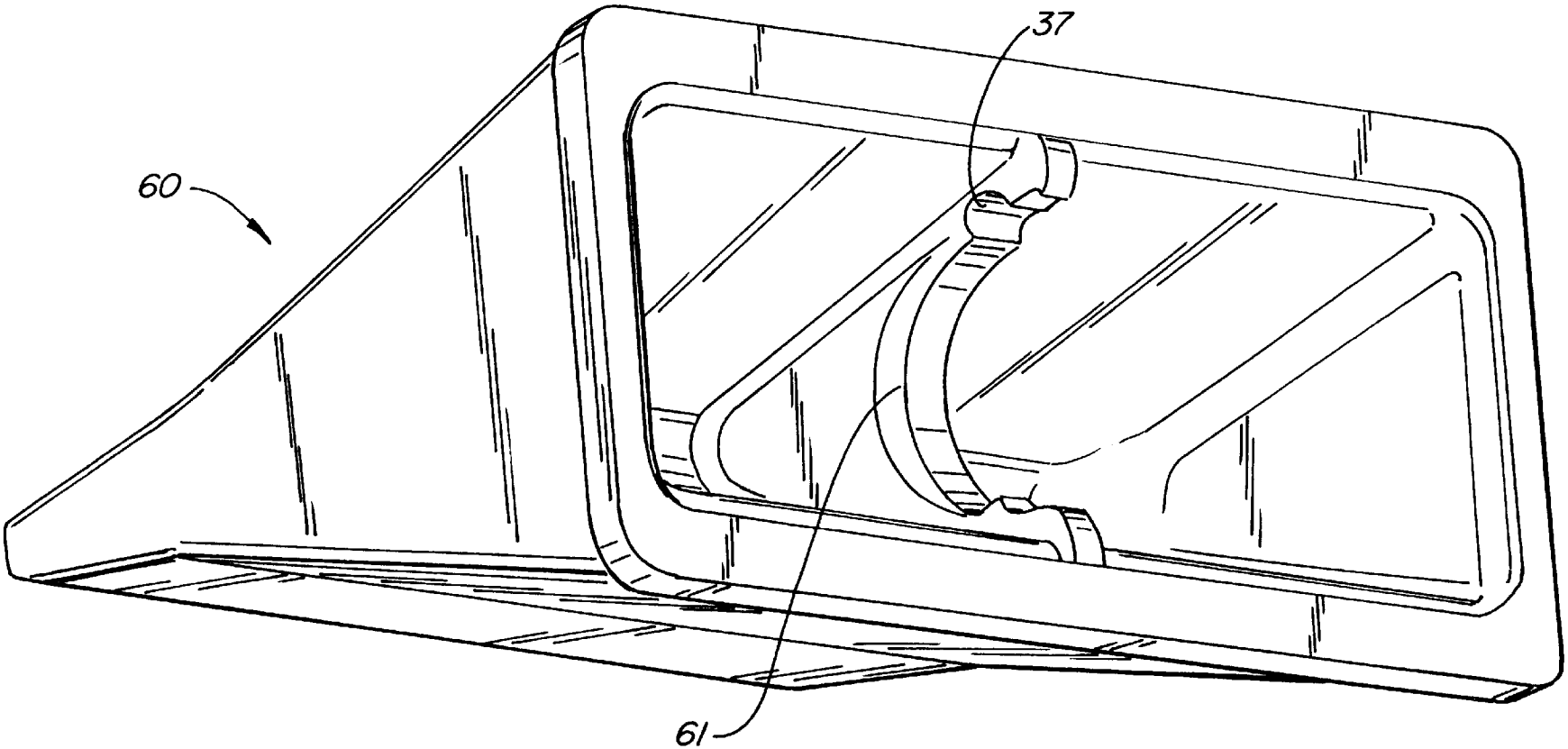
FIG. 6 is a perspective view of a dragline tooth and its interior.
Figure 7:
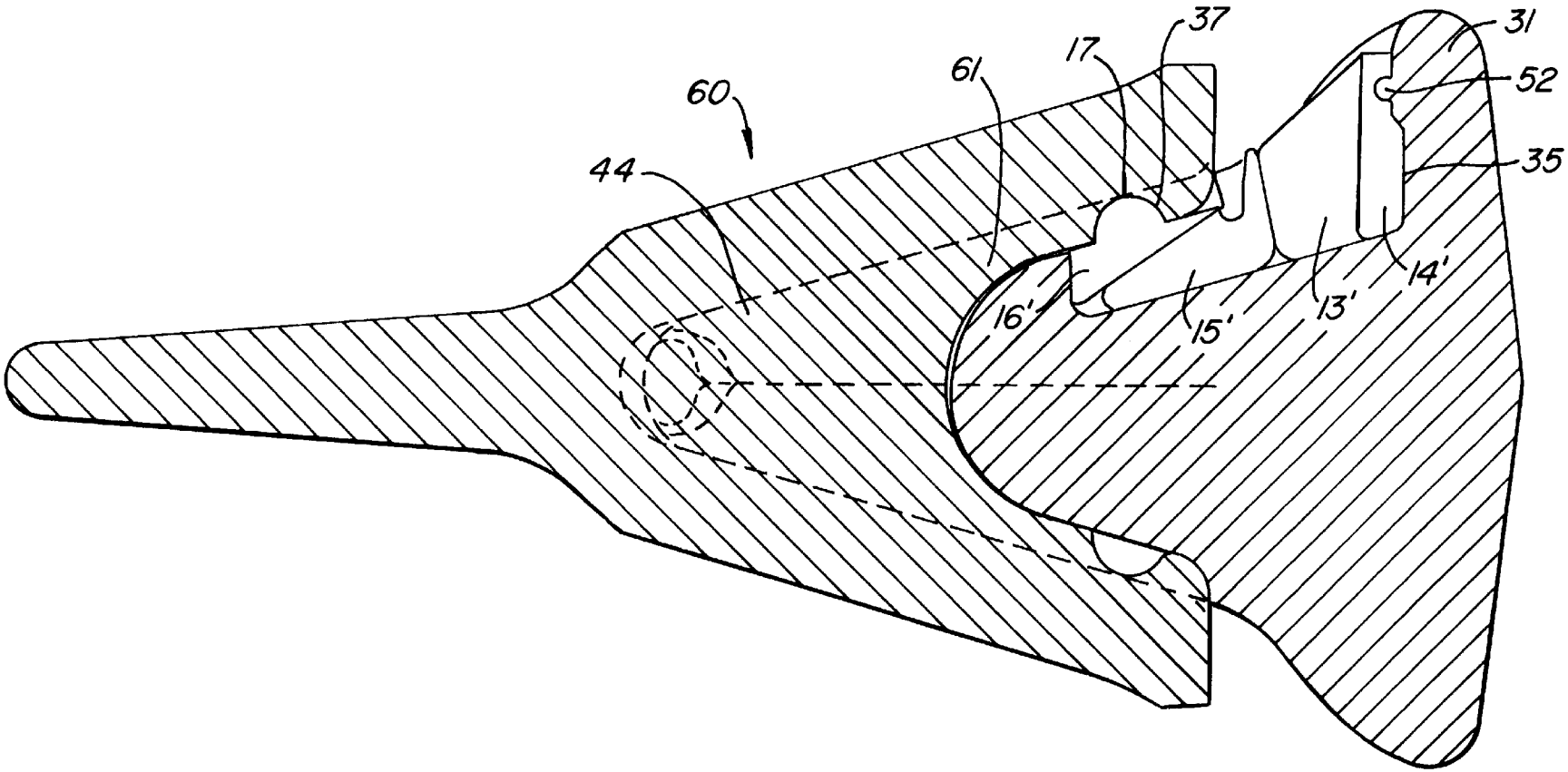
FIG. 7 is a sectional view of a dragline tooth coupled to an adaptor with a connection system in accordance with the present invention.
Figure 8:
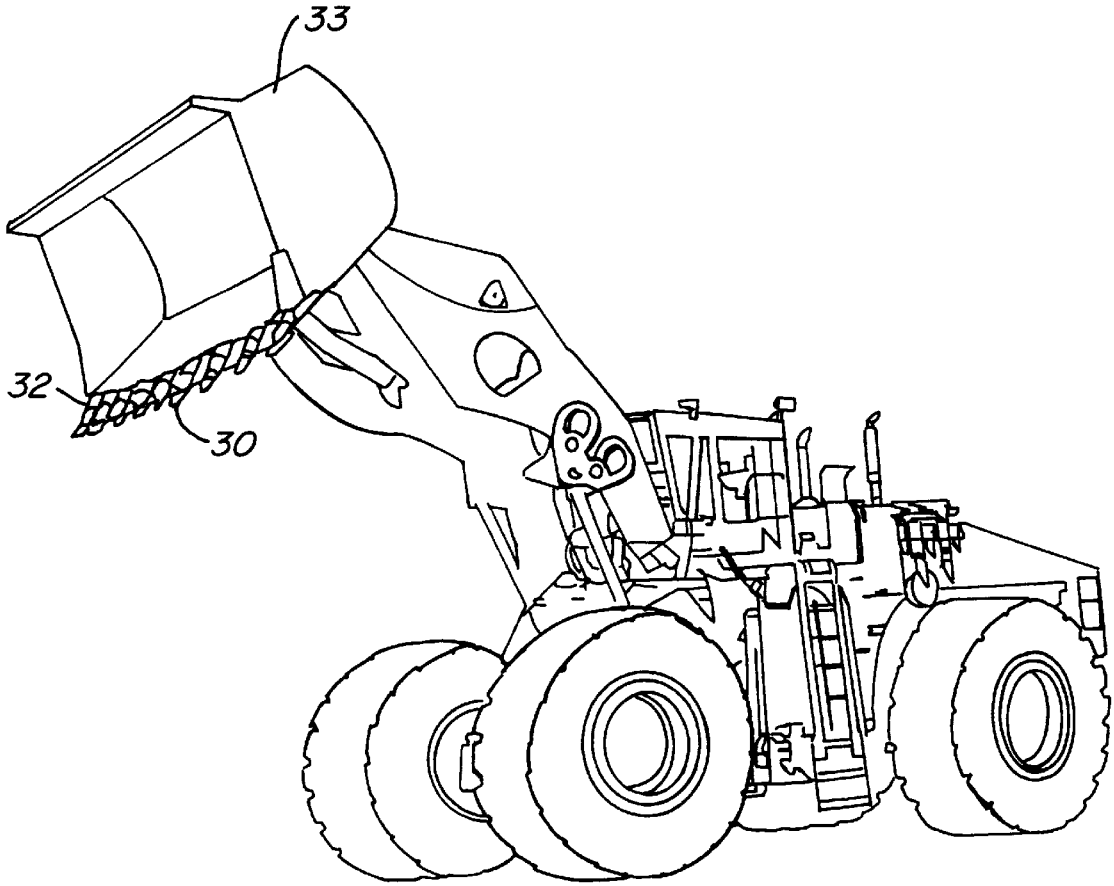
FIG. 8 is a perspective view of an excavating apparatus.

FIG. 6 illustrates an interior of a dragline tooth used with dragline buckets that are generally very large. Dragline tooth 60 includes a web 61 that extends through the center of the tooth. A notch 37' is defined within the web and serves as interference portion 36 for dragline tooth 60. FIG. 7 illustrates a connection system 10' coupling a dragline tooth 60 to an adaptor 31'. Of course, connection system 10 may be used if it is so desired. The method of inserting and disengaging connection system 10, 10' with a dragline tooth 60 and adaptor 31' is substantially the same as previously described.

Figure 9:
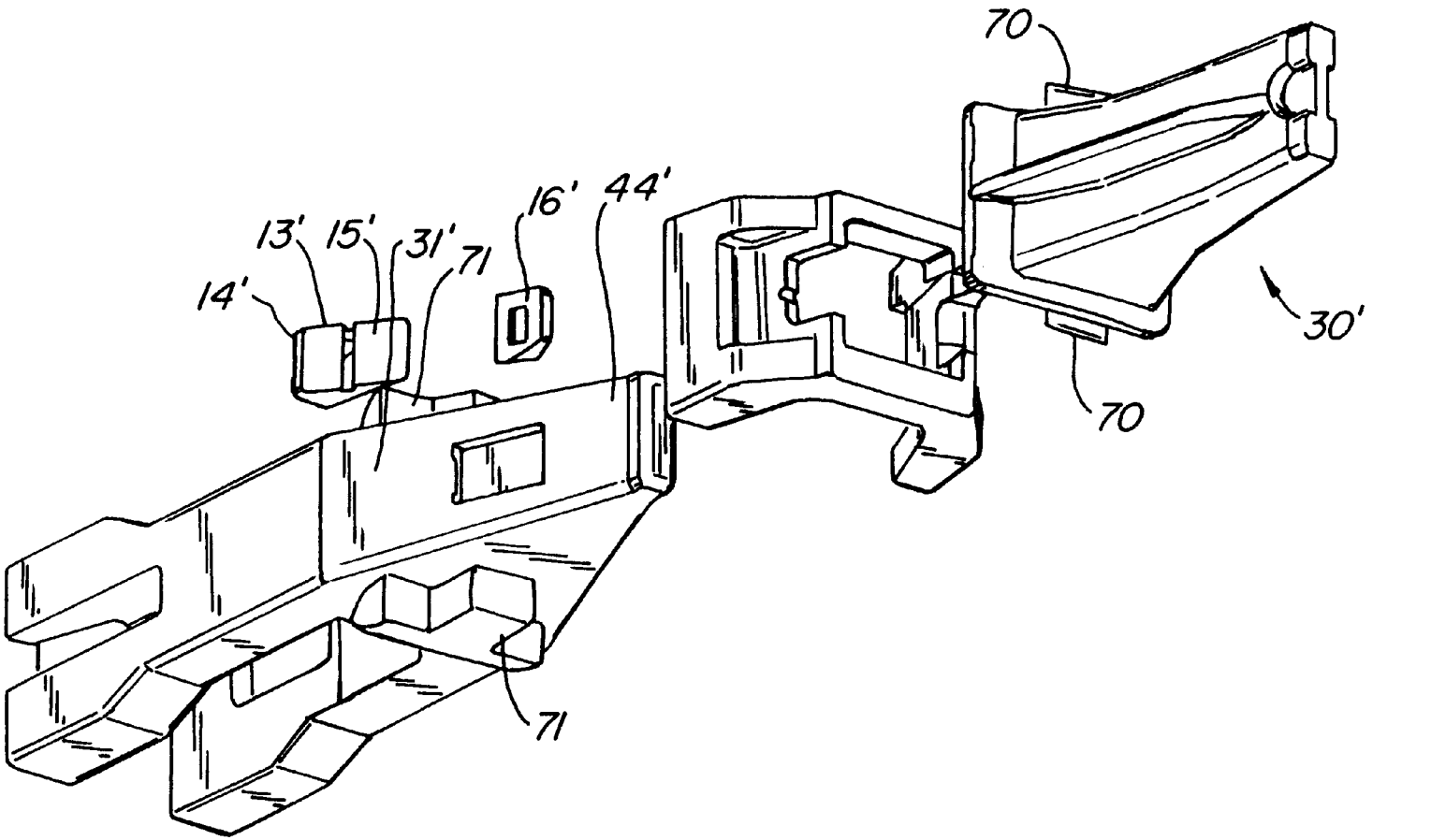
FIG. 9 is a sectional view of an alternative embodiment of a tooth coupled to a adaptor.

FIG. 9 illustrates an alternative embodiment of an adaptor 31' wherein nose 44' is shorter and does not extend fully into tooth 30 and thus a slight space is defined between nose 44' and tooth 30 when tooth 30 is coupled to adaptor 31 with either connection system 10 or connection system 10'. In this embodiment, flanges 70 are provided at the rear of tooth 30' and engage flanges 71 on the sides of adaptor 31 when tooth 30' is coupled to adaptor 31. This allows for transmission of lateral forces between tooth 30' and adaptor 31 during use.

Accordingly, the present invention provides a connection system that securely couples two items together that are configured to receive such a connection system. The connection system is ideally suited for connecting teeth to adaptors on excavating buckets and the like. The connection system eliminates the need for a hole within the teeth for receiving a pin since a pin is no longer needed. Since the connection system is self-tightening, less work is required to fabricate the teeth because tolerances are improved. The connection system prevents dirt from entering between the tooth and the adaptor thereby preventing wear of the adaptor and thus lowering the frequency, and possibly even eliminating, the need for replacing the adaptor.

Furthermore, the tightness of fit and the full surface contact along the sides and bottom of the tooth over the nose prevent relative motion, thereby preventing wear on the surface between the tooth and the adaptor, which also greatly extends the life of the adaptor. The tooth is virtually immovable on the adaptor and thus prevents wear on the interior of the tooth as well as the nose of the adaptor, and additionally promotes good transfer of forces between the tooth and the adaptor and thereby to the bucket on which the adaptor is attached. Furthermore, the tightness of fit is achieved by not requiring tight manufacturing tolerances because any play between the adaptor and the tooth is taken up by biasing the locking section further under the interference section.

Because the connection system includes portions made of elastomeric material, preferably rubber, the connection system biases the locking section under the interference section to thereby create a tight "wedged" lock between the two angled surfaces. If the tooth encounters a large object, and thus is subjected to heavy force, the tooth may simply move back toward the adaptor and the connection would become tighter by compressing the biasing portion.

Since a hammer is not required to remove the connection system, the chance of injury is minimized.

The connection system is also reusable and thus eliminates the cost of replacing pins associated with each changing of a tooth.

Although the invention has been described with reference to specific exemplary embodiments, it will be appreciated that it is intended to cover all modifications and equivalents within the scope of the appended claims. For example, the connection system has been described as having several portions connected, which is not required. Additionally, the receiving portion surface on which the connection system rests may be angled to provide the wedging effect. Also, other arrangements may be used to provide the interference fit between the tooth and the connection system.

What is claimed is:

1. A bucket for an excavation apparatus, the bucket comprising a bucket body having a lip running longitudinally along a bottom front portion of the bucket body, at least one adaptor coupled to the lip and including a receiving portion defined therein that includes an abutment wall, and a tooth defining a longitudinal axis connected to the adaptor with a connection system and including an interference portion, the connection system comprising:

a. a biasing portion adjacent the abutment wall;

b. a locking portion adjacent the biasing portion that includes an angled surface oriented with respect to the longitudinal axis; and c. an interference section adjacent the locking portion and that engages the interference portion, the interference section including an angled surface oriented with respect to the longitudinal axis that engages the angled surface of the locking portion.

2. The bucket of claim 1 wherein the locking portion and the interference section are separate pieces.

3. The bucket of claim 2 wherein the locking portion is connected to the biasing portion via a hinge.

4. The bucket of claim 3 wherein the interference portion comprises a notch defined within the tooth and the interference section comprises a projection.

5. The bucket of claim 4 wherein the biasing portion includes a biasing section consisting of an elastomeric material and an abutment section.

6. The bucket of claim 5 wherein the abutment section consists of a substantially non-elastomeric material.

* * * * *